US006041921A

United States Patent [19]

Staiano et al.

[11] Patent Number: 6,041,921

[45] Date of Patent: Mar. 28, 2000

[54] SMOKING APPARATUS AND SYSTEM

[75] Inventors: Mark J. Staiano, Atlanta; Gregory R. Scott, Dunwoody, both of Ga.

[73] Assignee: Top Shelf Enterprises, Inc., Atlanta, Ga.

[21] Appl. No.: 08/893,460

[22] Filed: Jul. 11, 1997

[51] Int. Cl.[7] ..... B65D 69/00

[52] U.S. Cl. ..... 206/236; 206/244; 206/260; 206/495

[58] Field of Search ..... 206/242, 244, 206/260, 261, 263, 495, 527, 805, 37, 38, 236, 372, 373, 237, 238; 383/38, 39, 40, 109, 119, 120

[56] References Cited

U.S. PATENT DOCUMENTS

| | | | |
|---|---|---|---|
| D. 13,395 | 11/1882 | Haas . | |
| D. 122,811 | 10/1940 | Adams . | |
| D. 139,417 | 11/1944 | Glafke . | |
| D. 142,108 | 8/1945 | Morris . | |
| D. 155,074 | 9/1949 | Chase . | |
| D. 236,630 | 9/1975 | McMananey . | |
| 1,589,118 | 6/1926 | Cowen | 206/260 |
| 1,672,766 | 6/1928 | March | 206/236 |
| 1,705,829 | 3/1929 | Stanley . | |
| 1,920,193 | 8/1933 | Gary | 206/236 |
| 1,991,306 | 2/1935 | Woolsey | 383/39 |
| 2,075,629 | 3/1937 | Singer et al. | 206/236 |
| 2,166,885 | 7/1939 | Wiseman . | |
| 2,236,024 | 3/1941 | Tyler . | |
| 2,387,790 | 10/1945 | Williamson | 206/244 |
| 2,624,454 | 1/1953 | Korenman | 206/236 |
| 2,806,588 | 9/1957 | June | 206/236 |
| 3,949,916 | 4/1976 | Yount . | |
| 4,214,658 | 7/1980 | Crow . | |
| 4,600,022 | 7/1986 | Pierce, Jr. . | |
| 4,685,570 | 8/1987 | Medow | 383/40 |

*Primary Examiner*—Paul T. Sewell
*Assistant Examiner*—Luan K. Bui

[57] ABSTRACT

The invented apparatus includes a wallet-like foldable member and a receptacle for storage of smoking material. The apparatus can also include a holder attached to the foldable member. One or more smoking accessories such as a pipe and a poker can be removably secured in the apparatus by the holder. In its folded configuration, the member stores the receptacle and any stored smoking accessory in a relatively compact configuration that can readily fit in a shirt or pants pocket for convenient carrying. When unfolded into its opened position, the member exposes the stored receptacle and smoking accessory(ies) so that such items can be selectively removed for use. The invented system includes the apparatus's member and receptacle, and in addition, includes at least one smoking accessory such as the pipe and poker. The system thus constitutes a smoking kit capable of holding substantially all smoking necessities.

19 Claims, 8 Drawing Sheets

SMOKING APPARATUS AND SYSTEM

BACKGROUND OF THE INVENTION

1. Field of the Invention

This invention is directed to a smoking apparatus and system for use with tobacco or other smoking material. The apparatus and system include a receptacle for storage of the smoking material, and is capable of storing smoking accessories such as a pipe, a poker, cigarette rolling papers, matches, a lighter or the like.

2. Description of the Related Art

U.S. Pat. No. 4,214,658 (referred to hereinafter as "the '658 patent") discloses a smoking system that includes a receptacle defining two cavities. In the first cavity, smoking material such as tobacco is stored. In the second cavity, a spring is inserted. A pipe is inserted into the second cavity for storage, and its end abuts the spring. When the opposite end of the pipe is pushed into the second cavity by forcing the spring to compress, a cover can be slid under opposing guides arranged along the top sides of the receptacle, to cover the open ends of the two cavities to store the tobacco and pipe. Upon sliding the cover off the receptacle, the pipe is forced by the spring to protrude from the second cavity so that it can be gripped and removed from the second cavity. With the cover removed, the receptacle can be tipped to empty a portion of the tobacco stored in the first cavity for use.

Although the '658 patent is meritorious in the sense that it provides a relatively compact smoking system, it can accommodate only very limited amounts of smoking material due to the relatively small size of the storage cavity. In addition, the smoking system of the '658 patent can only store a pipe and smoking material, and cannot store other desirable smoking accessories such as a poker to clear the pipe, matches, a lighter, cigarette rolling papers and the like. In addition, the cover of the smoking system of the '658 patent is relatively difficult to insert and remove from the receptacle. It would be desirable to overcome these disadvantages of the '658 patent.

U.S. Pat. No. 2,075,629 (referred to hereinafter as "the '629 patent") discloses a combined tobacco pouch and pipe holder. The pouch of the '629 patent is relatively large, with a correspondingly large flap. At the end of the pouch, a button hole is provided to allow the pipe mouthpiece to be inserted inside of the pouch. The tobacco and the pipe are secured by rolling up the pouch so that the flap closes over the pipe and pouch.

Although the '629 patent is meritorious in accommodating a relatively large amount of smoking material, it is adapted for relatively large pipes on the order of several inches in length. Accordingly, the tobacco and pipe holder of the '629 patent is relatively bulky and difficult if not impossible to carry in one's shirt or pants pocket, for example. In addition, the '629 patent has no means for holding other smoking accessories such as a poker, matches, a lighter, cigarette rolling papers, pipe cleaners or the like. It would be desirable to overcome these disadvantages of the prior art.

SUMMARY OF THE INVENTION

This invention overcomes the above-noted disadvantages. Broadly stated, the invented smoking apparatus includes a foldable member and a receptacle for storing smoking material such as tobacco. The receptacle is fixed to one of two sides of the member that are separated by the member's folding portion at which the member can be folded open or closed. In its opened position, the member exposes the receptacle containing smoking material and any stored smoking accessory or cigarette so that they can be selectively extracted by a person for use. Conversely, in its closed position, the member folds into a relatively compact, preferably pocket-sized, configuration that encloses the receptacle and any stored smoking accessory or cigarette.

Preferably, the member's two sides are relatively stiff and the folding portion is relatively flexible so that the member is biased to fold at its folding portion. For example, the member can be composed of two panels and a larger material piece that are sheet-like in configuration. The panels and piece can be cut from a sheet of leather, canvas, vinyl or other material. The panels are fixed on opposite sides of a section of the piece that constitutes the folding portion. The panels reinforce the piece on the opposite sides of the folding portion so that the member has the combined thickness of the panels and piece on its two sides, and is relatively thin and therefore flexible at the folding portion where the member's thickness is approximately only that of the piece. In addition, by attaching the two panels on the same surface of the piece, the member is biased to fold in a preferential direction that tends to bring the two panels together.

For storage of a smoking accessory or cigarette, the apparatus preferably includes a holder attached to the foldable member. In a preferred configuration, the holder is a resilient band that is attached to the member so as to define loops for removably securing one or more smoking accessories or cigarettes. The band can be positioned and attached to the member so that it extends underneath and between the two panels across the folding portion to form a loop for storing a smoking accessory or cigarette. The band can also extend through slits defined in one of the first and second panels to form another loop for storing an additional smoking accessory such as a pipe, or a cigarette. Alternatively, the holder can be a pocket or clip attached to the member, to which a smoking accessory or cigarette can be removably attached. One of the two panels can define a pair of holes to receive a smoking accessory such as a poker.

In a preferred embodiment, the receptacle is a pouch that includes a compartment and a flap that are fixed to one of the member's two sides. The flap can be detachably secured against the compartment to contain any smoking material in the pouch with a fastener. In a preferred configuration, the receptacle's fastener includes complementary Velcro fastenings fixed to respective portions of the pouch and flap. Alternatively, the fastener can be a snap fastener or a zipper that detachably secures the flap and compartment together. Also preferred, the compartment can include a liner to help retain the moisture content of the smoking material. The member can also include an additional receptacle such as a pouch fixed to an outside surface of the member for storage of additional smoking accessories such as matches, a lighter, cigarette rolling papers or the like.

The invented system includes the apparatus described hereinabove, and in addition, includes at least one smoking accessory such as a pipe and poker, that can be stored in the apparatus. The system thus constitutes a kit capable of storing substantially all of the necessities required for smoking.

These together with other features and advantages, which will become subsequently apparent, reside in the details of construction and operation as more fully hereinafter described and claimed, reference being made to the accompanying drawings, forming a part hereof, wherein like numerals refer to like parts throughout the several views.

DESCRIPTION OF THE PREFERRED EMBODIMENTS

Figure 1:
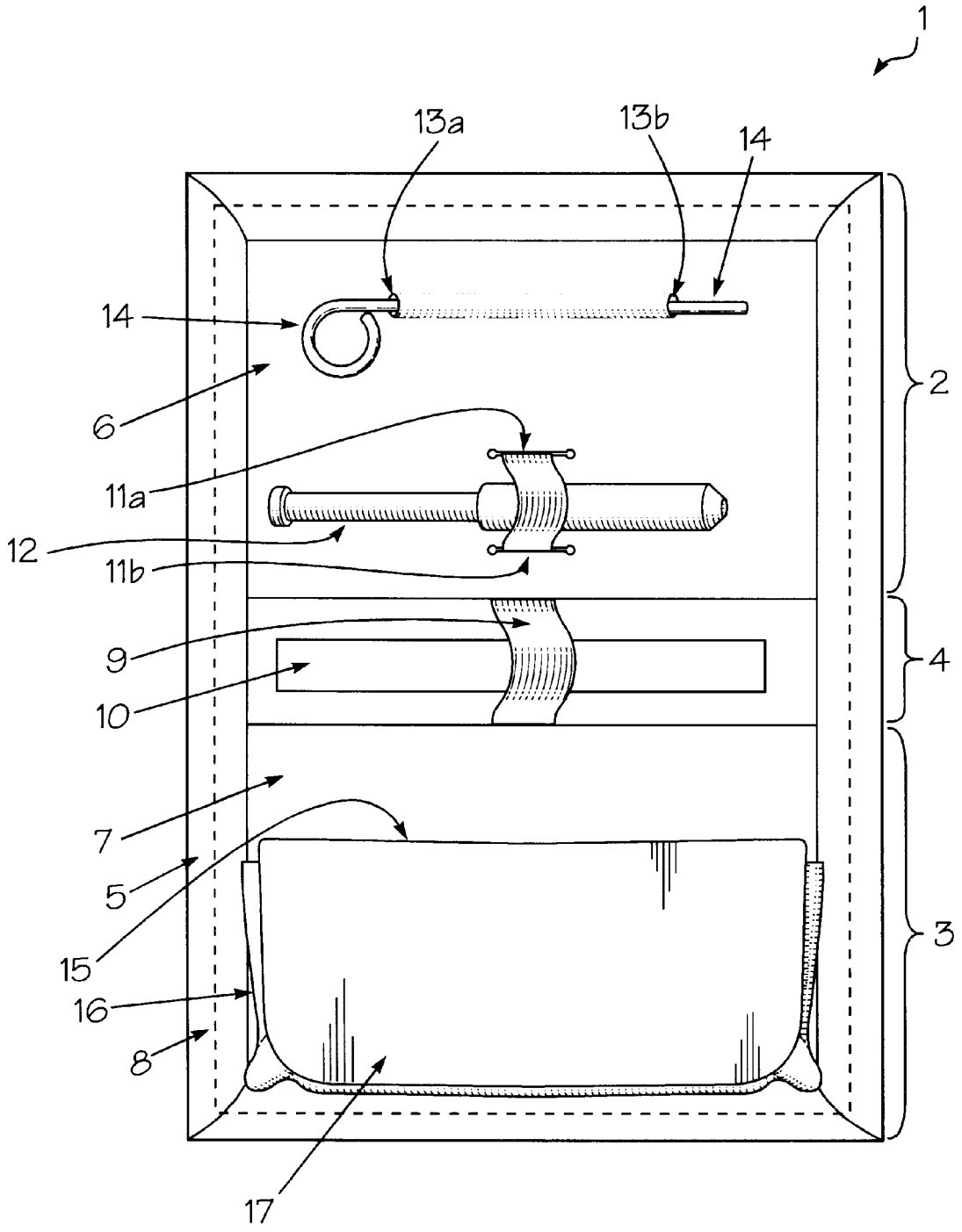
FIG. 1 is a view of a smoking apparatus and system with foldable member in its opened position to reveal a closed pouch receptacle, and stored pipe, poker and cigarette.

In FIG. 1, an apparatus and system in accordance with this invention include a foldable member 1. The member 1 has two sides 2, 3 and a folding portion 4. The folding portion extends horizontally across the member in FIG. 1 and separates its two sides. The portion 4 is relatively flexible to allow the member to be folded closed by bringing the two sides together, or conversely, to allow the member to be folded into its opened configuration that is shown in FIG. 1. Preferably, the two sides 2, 3 are relatively stiff and the portion 4 is relatively flexible so that the member tends to fold at the portion 4 rather than at the sides 2, 3.

The member can include a piece 5, and panels 6, 7. The piece 5 and the panels 6, 7 are preferably made of a flexible sheet material such as leather, canvas, vinyl or other material. For example, the panels 6, 7 are fixed to the piece 5 by folding and fixing the edges of the piece over the edges of the first and second panels. Preferably, the edges of the piece 5 are secured to the edges of the panel with a sew line 8 composed of relatively thick thread, that is sewn about the periphery of the piece 5. In addition or as an alternative to the sew line 8, an adhesive can be applied to the edges of the piece 5 and the panels 6, 7 to fix them together.

The apparatus can include a holder 9 for storing one or more smoking accessories or cigarettes. The holder is attached to the foldable member. The holder can be implemented with a variety of devices such as a clip, a pocket or a resilient band. In a preferred configuration, the holder 9 is implemented as a resilient band that has ends attached underneath respective panels 6, 7, and that extends across the foldable member's folding portion defined between the two panels. The band holder 9 forms a loop that can removably secure a cigarette 10, or alternatively, a smoking accessory in contact with the foldable member at its folding portion. The band holder 9 also extends through a pair of slits 11*a*, 11*b* defined in the panel 6 to form a second loop. The second loop can be used to removably secure a pipe 12 or other smoking accessory. The pipe 12 can be included as an element of the smoking system in addition to the apparatus that includes the foldable member 1 and the receptacle 15. The pipe 12 can be one of a number of varieties of relatively small pipes, including a pipe such as that commercially available from Simple Pleasures, Inc. of Romeoville, Ill. The panel 6 also defines a pair of holes 13*a*, 13*b* that removably secure a poker 14. The poker 14 can be included as an element of the smoking system. The poker 14 is preferably composed of a relatively sturdy piece of wire that is bent at one end to form a ring-like configuration to provide a fingerhold.

To the panel 7, a receptacle 15 is attached. In the preferred embodiment, the receptacle is a pouch, although other configurations are possible for use in the invented apparatus and system. The pouch receptacle holds a smoking material such as tobacco (not shown). The pouch can be composed of leather, canvas, vinyl or other material, that is sewn together, preferably with a relatively thick thread, to form the pouch. The pouch receptacle 15 includes a compartment 16 and a flap 17 that covers the pouch opening. The compartment and flap are preferably fixed to the foldable member by sewing with a thread and/or with an adhesive substance. The flap and/or compartment include a fastener for detachably securing the flap to the compartment to close the pouch receptacle.

Figure 2:
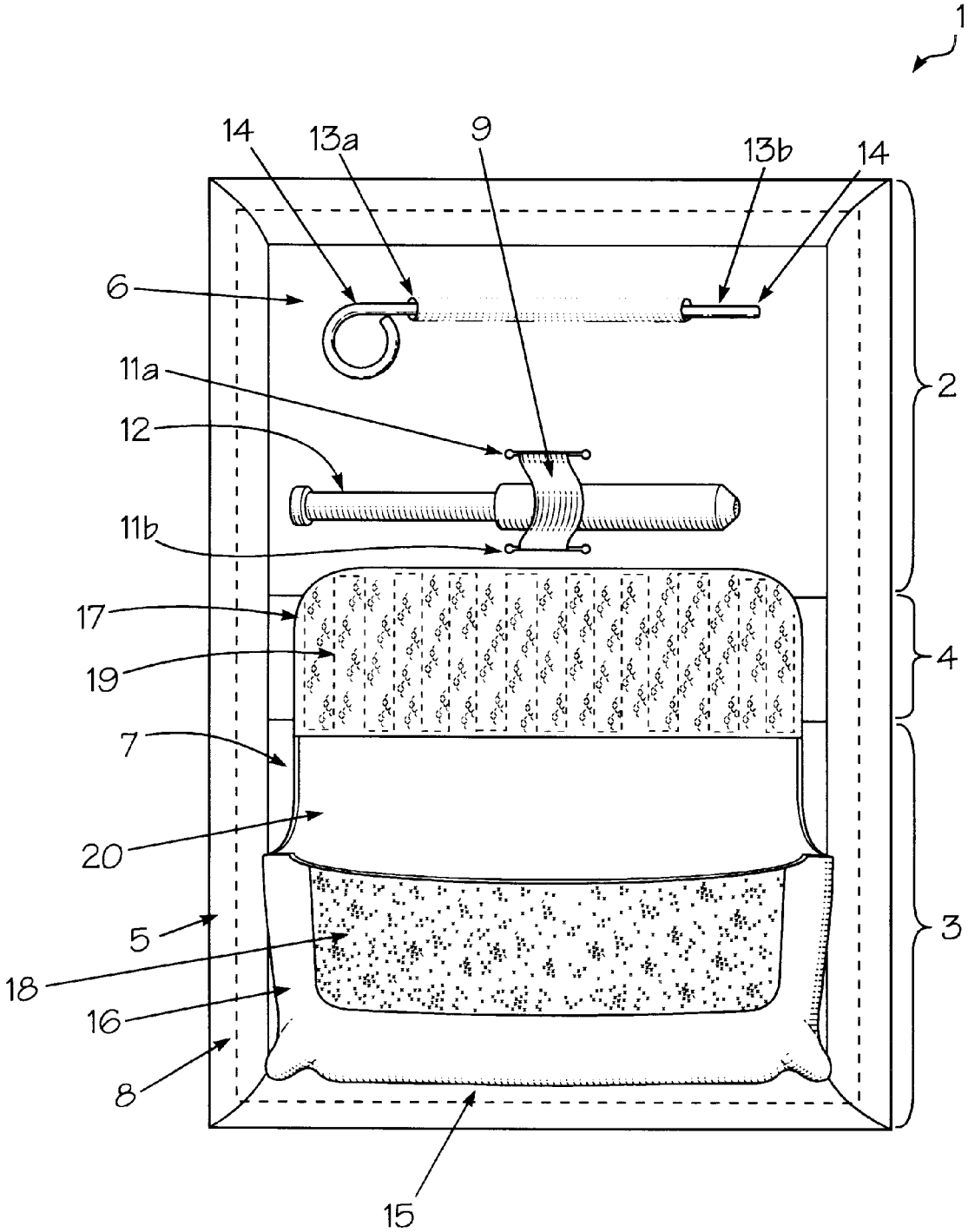
FIG. 2 is a view of the apparatus and system in its opened position with the pouch receptacle's flap opened.

FIG. 2 shows the pouch receptacle 15 in its opened position with the flap 17 detached from the compartment 16. In its opened position, the pouch receptacle reveals Velcro fastenings 18, 19 that constitute one possible implementation of the fastener. The fastening 18 includes a fibrous sheet attached to the exterior surface of the pouch with sewn thread or adhesive. The fastening 19 has hooks and is attached to the underside of the flap 17 by sewn thread or adhesive, for example. If the flap 17 is closed over the receptacle's opening, the hooks of the fastening 19 engage with the fibers of the fastening 18 to detachably secure the flap to the compartment. Although Velcro fastenings are generally preferred, other types of fasteners such as a snap fastener or zipper, can be used to secure the flap to the compartment. The interior of the pouch receptacle can be lined with a liner 20 formed of a relatively durable, yet flexible plastic material that is folded or formed into a pocket that fits inside of the compartment 16. If the flap is closed over the compartment 16, the liner 20 prevents or at least impedes the evaporation of moisture from the smoking material to preserve its freshness. The liner 20 also facilitates insertion or extraction of the smoking material into and out of the pouch by providing a smooth surface against which the smoking material and a person's fingers can be readily slid.

Figure 3:
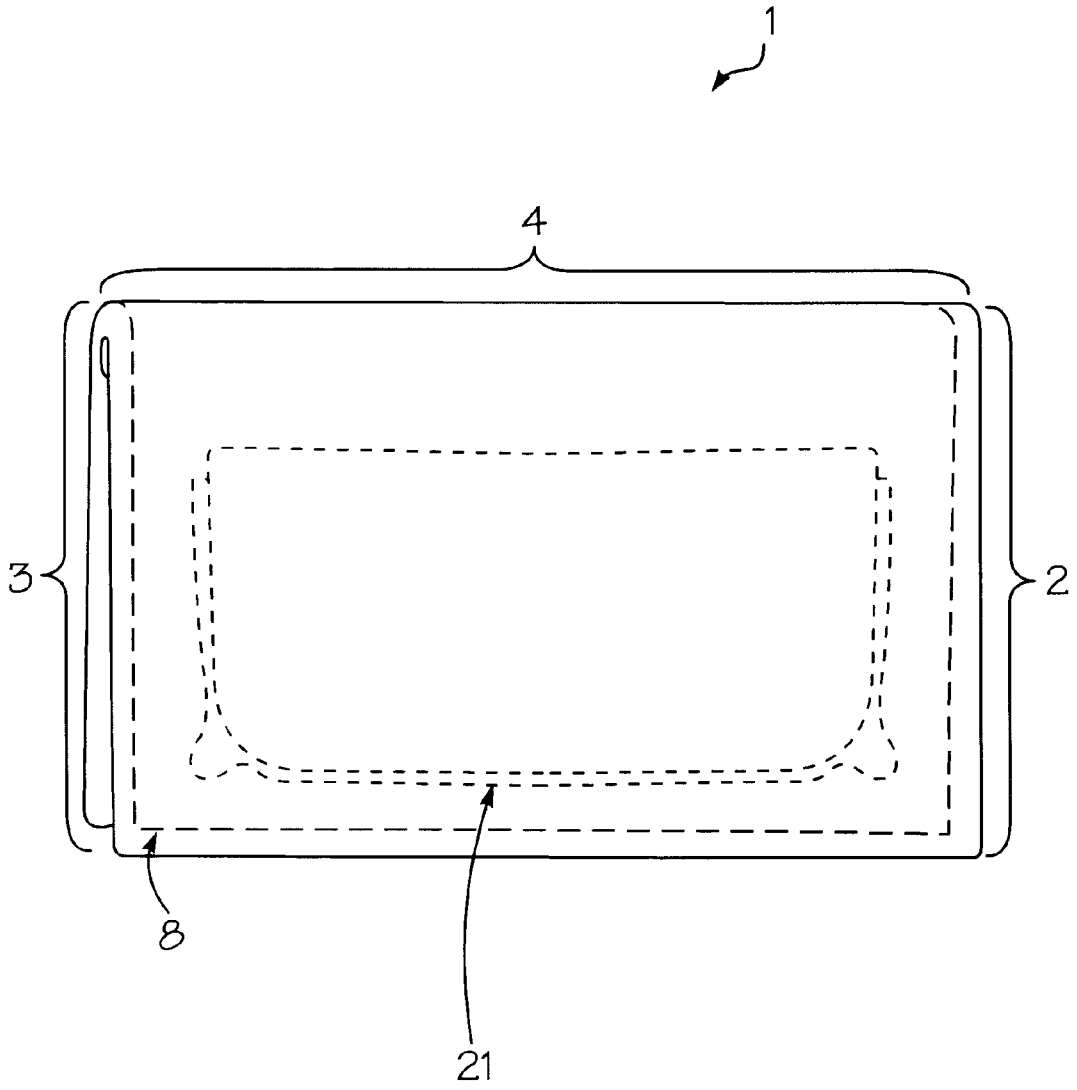
FIG. 3 is a view of the apparatus and system in its closed position revealing an optional exterior pouch receptacle.

FIG. 3 shows the apparatus and system I in its closed configuration in which the member 1 is folded at its folding portion to store and protect its contents which can include any stored cigarette 10, the pipe 12, the poker 14 and the interior pouch receptacle 15. In its closed configuration, the apparatus and system assumes a relatively compact position that can be held in a shirt or pants pocket. For example, in its closed position, the apparatus and system can measure from 1–4 inches in height, from 2–8 inches in width, and less than 2 inches in thickness. Optionally, the apparatus and system can include an exterior receptacle 21 that is attached to the outer surface of the member 1. The exterior receptacle 21 can be a pouch configured and made similarly to the interior receptacle pouch 15, and accordingly, a detailed description of the exterior pouch is omitted as redundant. The exterior pouch receptacle can be used to store smoking accessories, such as matches, a lighter, cigarette rolling papers or other items.

Figure 4:
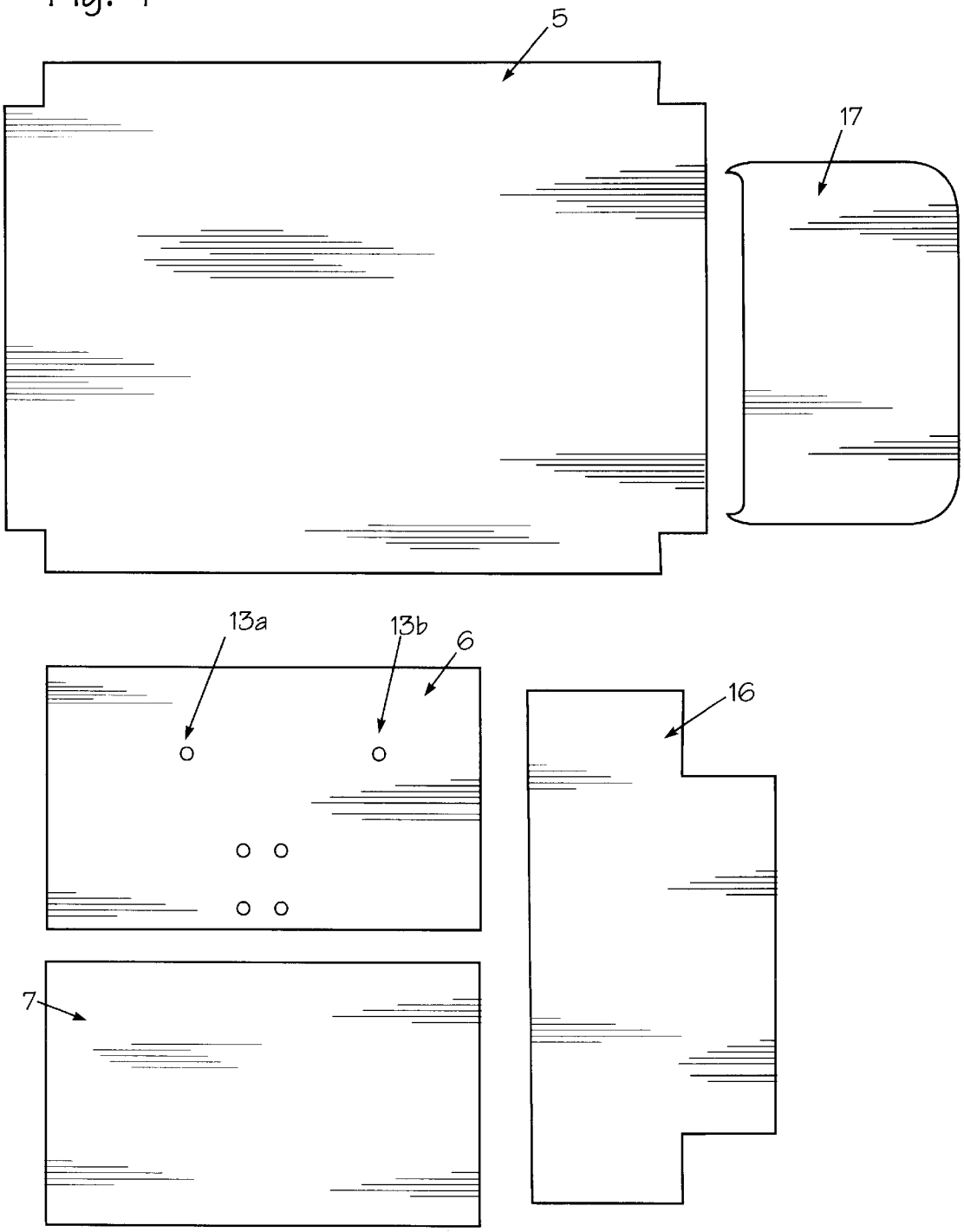
FIG. 4 is a view of a pattern for making the foldable member and pouch receptacle from a sheet of material.

FIG. 4 shows the pattern for making the piece 5, panels 6, 7, compartment 16 and the flap 17 from a sheet of flexible material such as leather, canvas, vinyl or other material. The panel 6 is punched with holes to allow ready entry of a cutting device to form the slits 11*a*, 11*b*. The punch holes also prevent the material from tearing beyond the desired extent of the slits 11*a*, 11*b*. The panel 6 is further punched to provide holes 13*a*, 13*b* for storage of the poker 14.

Figure 5:
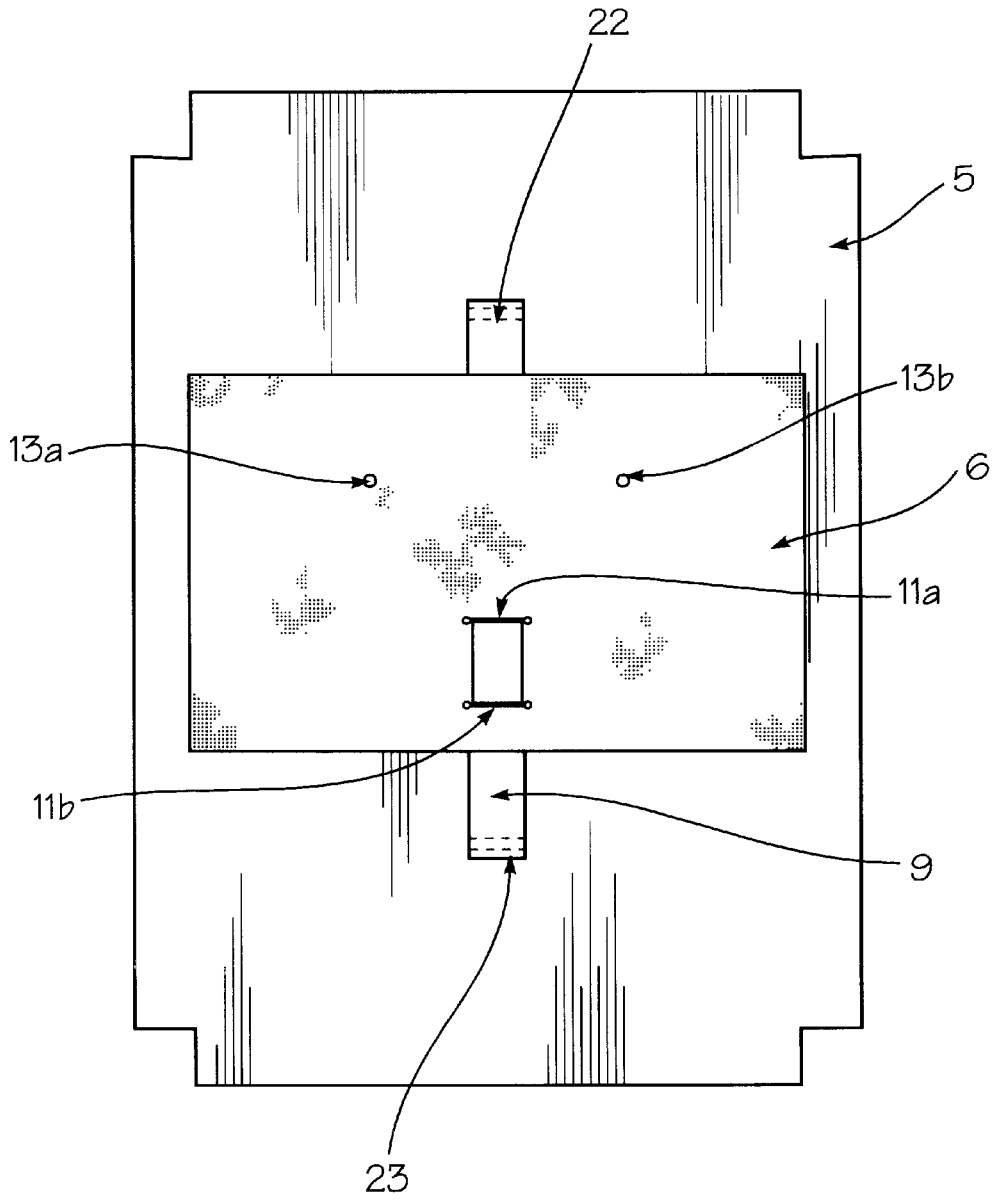
FIG. 5 is a view of a first stage of making the foldable member and attaching a resilient band thereto.
Figure 6:
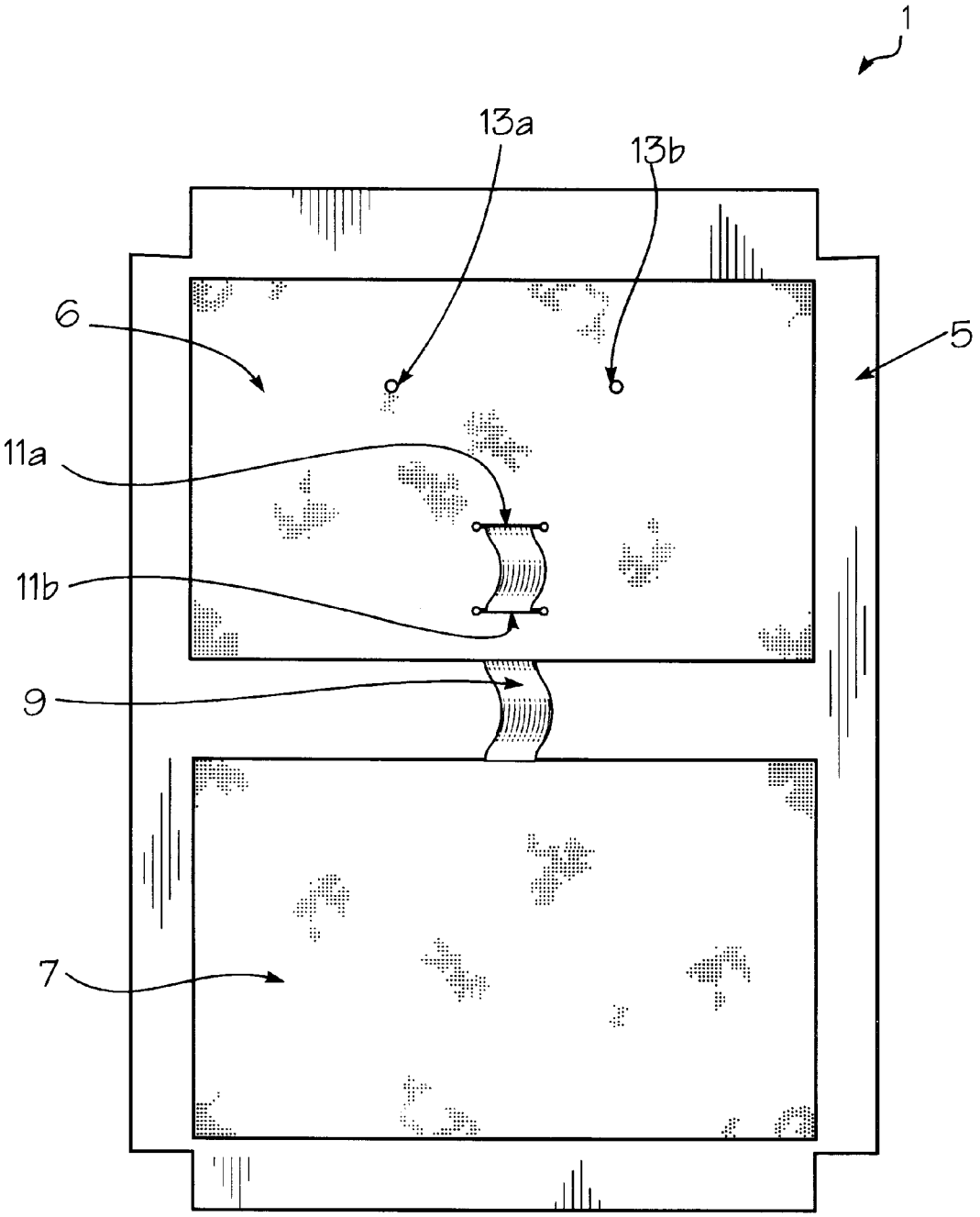
FIG. 6 is a view of a second stage of making the foldable member with attached resilient band.
Figure 7:
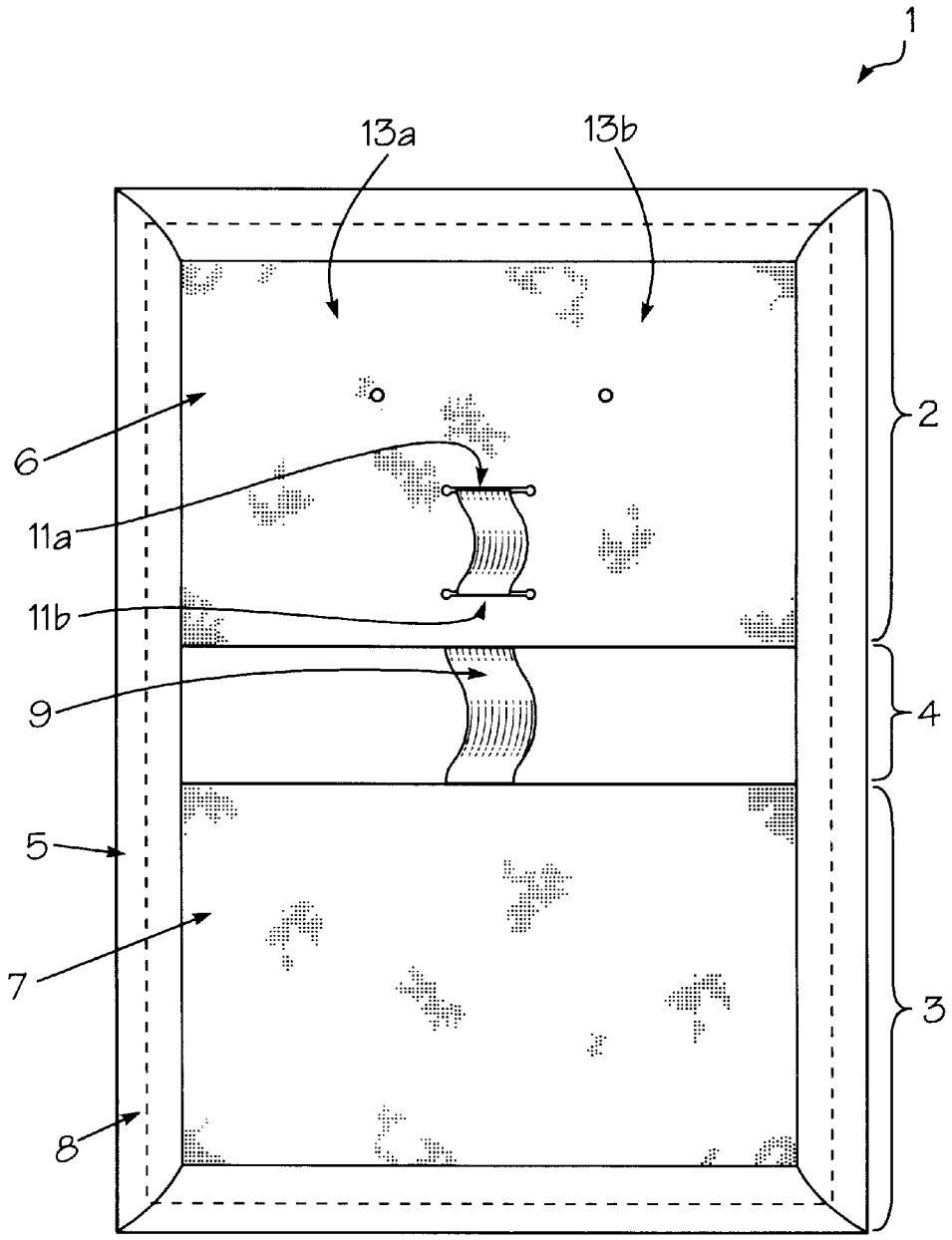
FIG. 7 is a view of third stage of making the foldable member with attached resilient band.

In FIG. 5, the foldable member 1 and the elastic band 9 are assembled together as follows. The slits 11*a*, 11*b* and holes 13*a*, 13*b* are cut in the panel 6 using the punch holes to allow a starting point for entry of the cutting device. The band holder 9 is fed through the slits 11*a* and 11*b*, and the ends of the band are sewn with thread lines 22, 23 to the piece 5. Alternatively or in addition to the sew lines 22, 23, the ends of the band can be attached to the piece 5 with adhesive. The band 9 is preferably relatively taught upon attachment of its two ends to the piece 5 so that the band will grip any cigarette or smoking accessory stored therein. In FIG. 6, the panel 6 is slid upward relative to its position in FIG. 5, toward the upper side of the piece 5 in FIG. 6. The panel 7 is positioned over the lower side of the piece 5. In FIG. 7, the edges of the piece 5 are folded over and sewn with thread to form the sew line 8 that holds together the piece 5 and the panels 6, 7. Alternatively or in addition to the sew line 8, adhesive can be applied to the opposing surfaces of the piece 5 and the panels 6, 7 to hold the piece and panels together. It should be noted that the panels 6, 7 reinforce and stiffen the two sides 2, 3 of the piece 5 whereas the folding portion 4 is not reinforced and has a thickness determined by that of the piece 5 except at the member's edges where the piece is folded over. The member 1 will thus fold at the fold line 4 upon closing the member 1. Also, because the panels 6, 7 are fixed to the same surface of the piece 5, the member will tend to close in a direction that joins the two panels together to oppose one another. The foldable member 1 is thus biased to fold in a direction that closes over the band holder 9 and any smoking accessories or cigarette stored therein, as well as the receptacle 15.

Figure 8A:
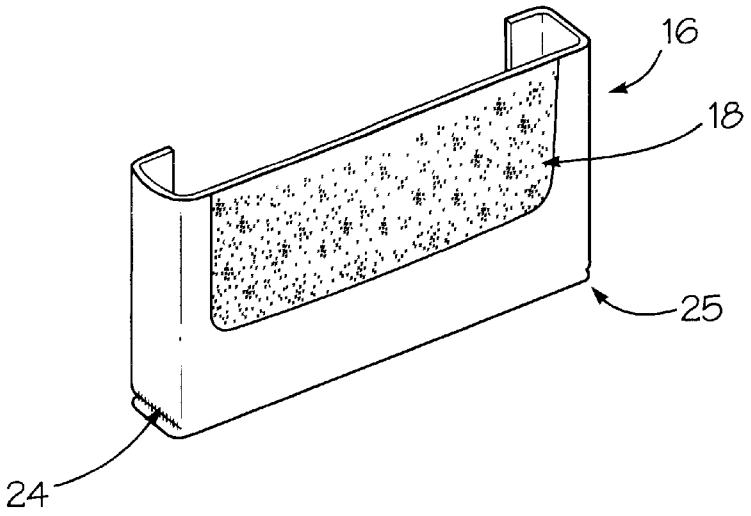
FIGS. 8A and 8B are perspective views of the pouch compartment formed from the pattern of FIG. 4.
Figure 8B:
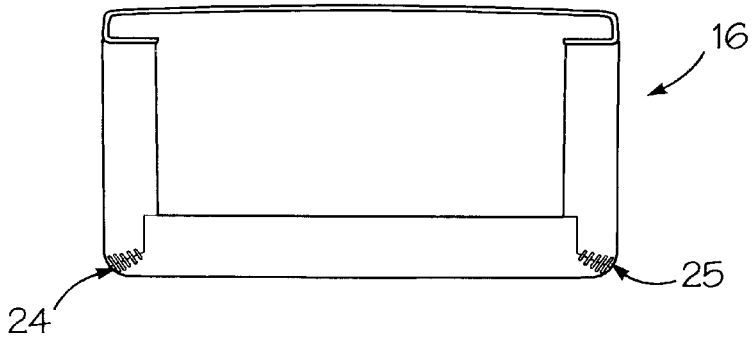
Figure 9:
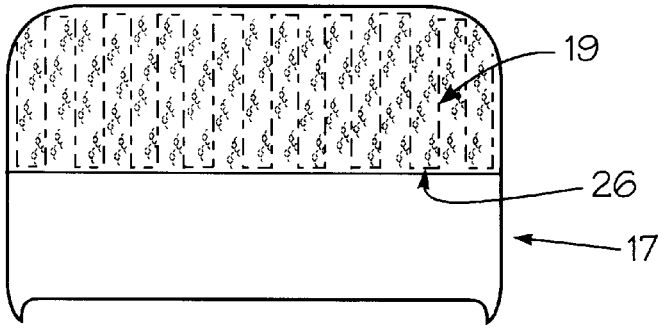
FIG. 9 is a view of the underside of the pouch receptacle's flap.

FIG. 8A shows a perspective view of the compartment 16 after completion of its manufacture. The compartment 16 is made from the pattern of FIG. 4 by folding the bottom and two side edges of the pattern together and sewing the opposing edges of the two sides and the bottom edges together with sew lines 24, 25 (sew line 25 is not visible in FIG. 8A). As is often done in leather working, the two side and opposing bottom edges can be sewn together and the compartment can then be turned inside out to form a more cosmetically appealing compartment. The Velcro fastener 18 is sewn with thread and/or adhered to the outer surface of the compartment 16. In FIG. 8B, the edges of the compartment 16 that are to be attached to the panel 7 are folded inwardly to provide a relatively large attachment area. The folded edges of the compartment are attached to the panel 7 by a sew line or an adhesive (not shown), resulting in a configuration as shown in FIG. 2. In FIG. 9, the fastening 19 is attached by sewing with a thread line 26 or with an adhesive to the flap 17 of the pattern of FIG. 4. The lower backside edge of the flap 17 (not visible in FIG. 9) is attached to the panel 5 by a sew line or with an adhesive, to form a configuration as shown in FIG. 2. A liner 20 can be adhered or otherwise attached inside of the compartment to form an enclosure for smoking material contained in the pouch receptacle.

For storage, as best seen in FIG. 2, smoking material can be inserted into the receptacle 15 and the flap 17 closed by folding the flap against the compartment's outside surface to engage the fastenings 18, 19. The pipe 12 or other smoking accessory can be inserted into the band's loop formed at slits 11*a*, 11*b* defined in the panel 6. The poker 14 can be inserted through the holes 13*a*, 13*b* defined in the panel 6 so that its two ends protrude from the holes while its middle portion is enclosed between the piece 5 on one side and the panel 6 on its other side. A cigarette or smoking accessory can be inserted into the band holder's loop where it extends across the member's folding portion 4, as best seen in FIG. 1. The apparatus or system, or more specifically, the member 1, can be folded at the portion 4 into a relatively compact closed configuration, as shown in FIG. 3. Due to its compact size, the folded apparatus or system can be readily carried in a shirt or pants pocket.

If the user desires to extract the stored cigarette 8 or the pipe 10, the apparatus or system can be folded open and the cigarette 10 or the pipe 12 can be removed from the foldable member. The receptacle 15 can be opened to allow extraction of smoking material stored therein for rolling a cigarette with rolling papers contained in the exterior receptacle 21, for example, or alternatively can be inserted into the pipe 12. A lighter or match stored in the exterior receptacle 21, for example, can be used to light the cigarette or pipe. If the pipe becomes clogged with smoking material residue, the poker 14 can be extracted from the foldable member and used to clear the pipe 12.

The many features and advantages of the present invention are apparent from the detailed specification and thus, it is intended by the appended claims to cover all such features and advantages of the described apparatus and system which follow in the true spirit and scope of the invention. Further, since numerous modifications and changes will readily occur to those of ordinary skill in the art, it is not desired to limit the invention to the exact construction and operation illustrated and described. Accordingly, all suitable modifications and equivalents may be resorted to as falling within the spirit and scope of the invention.

We claim:

1. An apparatus for storing smoking material and at least one smoking accessory, the apparatus comprising:

a foldable member having first and second sides separated by a folding portion of the member;

a holder attached to the foldable member, the holder including a resilient band attached to the foldable member to form at least one loop on the first side of the foldable member, to removably secure at least one smoking accessory; and a receptacle fixed to the second side of the foldable member, the receptacle for storing the smoking material, the receptacle including a pouch having a compartment, flap, and fastener for detachably securing the flap to the compartment to enclose the smoking material, the first and second sides of the member including first and second panels positioned on opposite sides of the folding portion, the resilient band extending underneath the panels across the folding portion to form a first loop for storing a first smoking accessory or cigarette, and the resilient band extending through slits defined in one of the first and second panels to form a second loop for storing a second smoking accessory or cigarette.

2. An apparatus as claimed in claim 1, wherein at least one of the first and second panels defines a pair of holes to receive a third smoking accessory.

3. A system for storing smoking material and optionally also at least one cigarette made from the smoking material, the system comprising:

a foldable member including a material piece having a folding portion, and first and second panels positioned on opposite sides of the folding portion of the piece, the first and second panels fixed to the piece;

at least one smoking accessory;

a holder including a resilient band having first and second ends fixed between the material piece and the first and second panels, respectively, the resilient band extending across the folding portion to form a first loop to removably secure at least one smoking accessory or at least one cigarette, the resilient band also extending through slits defined in the first panel to form a second loop for removably securing at least one smoking accessory; and a receptacle fixed to the second panel, the receptacle storing the smoking material, the receptacle including a pouch having a compartment, flap, and fastener for detachably securing the flap to the compartment to enclose the smoking material.

4. A system as claimed in claim 3, wherein the first and second sides are relatively stiff and the folding portion is relatively flexible.

5. A system as claimed in claim 3, wherein the first and second panels are fixed to the piece by folding and fixing the edges of the piece over the edges of the first and second panels.

6. A system as claimed in claim 5, wherein the edges of the piece are fixed to the first and second panels by a sew line.

7. A system as claimed in claim 5, wherein the edges of the piece are fixed to the first and second panels by adhesive.

8. A system as claimed in claim 3, wherein the receptacle includes a liner.

9. A system as claimed in claim 3, the system further comprising:

a pipe that can be removably secured in the second loop.

10. A system as claimed in claim 9, wherein the first panel defines a pair of holes, the system further comprising:

a poker that can be removably secured in the holes defined in the first panel.

11. A system as claimed in claim 10, wherein the foldable member can be folded at the folding portion into an opened position that exposes the pouch, pipe and poker removably secured in the foldable member, and wherein the foldable member can be folded at the folding portion into a relatively compact closed position that covers the pouch, pipe and poker.

12. A system as claimed in claim 3, further comprising:

a pipe constituting the smoking accessory that can be removably secured in the second loop.

13. A system as claimed in claim 3, wherein the first panel includes a pair of holes, the system further comprising:

a poker removably secured in a pair of holes defined in the first panel.

14. A system as claimed in claim 13, wherein the poker is made of wire with an end that is bent into a substantially ring-shaped configuration to provide a fingerhold.

15. A system as claimed in claim 3, further comprising:

an additional receptacle fixed to an outer surface of the foldable member, for storing smoking accessories.

16. A system as claimed in claim 15, wherein the additional receptacle includes a pouch with a compartment and a flap fixed to the outer surface of the foldable member.

17. A system as claimed in claim 16, wherein the flap can be detachably secured in a closed position over the opening of the additional receptacle with a fastener.

18. A smoking system for storing smoking material, the system comprising:

a foldable member including a material piece having a folding portion, and first and second panels positioned on opposite sides of the piece's folding portion, the first and second panels fixed to the piece by folding and fixing the edges of the piece over the edges of the first and second panels;

a receptacle for storing the smoking material, the receptacle fixed to the foldable member, the receptacle including a pouch having a compartment, flap, and fastener for detachably securing the flap to the compartment to enclose the smoking material;

a holder including a resilient band attached to the foldable member to define at least one loop;

a pipe capable of being removably secured in the foldable member in the loop defined by the holder; and a poker capable of being removably secured in the foldable member, the resilient band extending underneath and between the first and second panels to form a first loop for storage of a cigarette.

19. A system as claimed in claim 18, wherein the resilient band extends through a pair of slits defined in the first panel to form a second loop, the pipe being removably secured in the second loop.

* * * * *